US009503823B2

(12) United States Patent
Barzen et al.

(10) Patent No.: US 9,503,823 B2
(45) Date of Patent: Nov. 22, 2016

(54) CAPACITIVE MICROPHONE WITH INSULATED CONDUCTIVE PLATE

(71) Applicant: Infineon Technologies AG, Neubiberg (DE)

(72) Inventors: Stefan Barzen, Munich (DE); Andre Brockmeier, Villach (AT); Marc Fueldner, Neubiberg (DE); Stephan Pindl, Bad Abbach (DE); Wolfgang Friza, Villach (AT)

(73) Assignee: INFINEON TECHNOLOGIES AG, Neubiberg (DE)

( * ) Notice: Subject to any disclaimer, the term of this patent is extended or adjusted under 35 U.S.C. 154(b) by 0 days.

(21) Appl. No.: 14/582,223

(22) Filed: Dec. 24, 2014

(65) Prior Publication Data

US 2016/0192086 A1 Jun. 30, 2016

(51) Int. Cl.
*H04R 9/08* (2006.01)
*H04R 23/00* (2006.01)

(52) U.S. Cl.
CPC ..... *H04R 23/00* (2013.01)

(58) Field of Classification Search
CPC ..... H04R 23/00; H04R 19/00; H04R 19/04
See application file for complete search history.

(56) References Cited

U.S. PATENT DOCUMENTS 7,898,048 B2 3/2011 Nakatani
2009/0278216 A1 11/2009 Nakatani
2012/0328132 A1* 12/2012 Wang ..... H04R 19/04 381/174
2015/0129992 A1 5/2015 Hur et al.
2015/0358735 A1* 12/2015 Klein ..... H04R 7/02 257/416

FOREIGN PATENT DOCUMENTS

JP 2009028807 A 2/2009
KR 20130125433 11/2013
KR 101462375 B1 11/2014
SG WO 2012122696 A1 * 9/2012 ..... H04R 19/04

OTHER PUBLICATIONS

Pedersen et al., "On the Electromechanical behaviour of thin perforated backplates in silicon condenser microphones", The 8th International Conference on Solid-State Sensors and Actuators, and Eurosensors IX, Jun. 1995, p. 13-16, Transducers '95 Eurosensors IX, Stockholm, Sweden.
Ganji, "Design and Fabrication of a Novel MEMS Silicon Microphone", Crystalline Silicon—Properties and Uses, Jul. 2011, p. 313-328, InTech Europe, Croatia.
Yang, "The sensitivity analysis of a MEMS microphone with different membrane diameters", Journal of Marine Science and Technology, 2010, p. 790-796, vol. 18, No. 6.

* cited by examiner

*Primary Examiner* — Tuan D Nguyen

(57) ABSTRACT

A capacitive microphone may include a housing, a membrane, and a first backplate, wherein a first insulating layer may be disposed on a first side of the first backplate facing the membrane and a second insulating layer may be disposed on a second side of the first backplate opposite to the first side of the first backplate. A further insulating layer may be disposed on a side wall of at least one of a plurality of perforation holes in the first backplate. Each conductive surface of the first backplate may be covered with insulating material.

9 Claims, 14 Drawing Sheets

CAPACITIVE MICROPHONE WITH INSULATED CONDUCTIVE PLATE

TECHNICAL FIELD

Various embodiments relate generally to a capacitive microphone with at least one conductive backplate that is partially or fully encapsulated by insulating material.

BACKGROUND

Capacitive silicon microphones are designed with a membrane and either one or two backplates separated by an air gap. Sound is transduced into electrical signals by detecting the varying capacitance between the membrane and the backplates as the membrane vibrates in response to sound waves. An electrical field is therefore required across the membrane and backplate electrodes. This electrical field is generally supplied by an Application Specific Integrated Circuit (ASIC) in the form of a bias voltage applied across the electrodes. The output of the ASIC is typically high-Ohmic in order to support a highly sensitive microphone with a high signal to noise ratio (SNR) and low current consumption. Consequently, the membrane and backplate electrodes must be well insulated from each other.

A reduction in insulation and resulting current leak between the electrodes can be caused by moisture, residue, or other particles and contamination that become connected between the electrodes. These current leaks can lead to increased noise, increased current consumption, and/or loss of sensitivity of the microphone system.

Many current microphone systems may place an insulating layer on the backplate facing the membrane in order to further insulate the electrodes from one another. This may accordingly prevent a current leak from this face of the backplate and the membrane. However, this cannot prevent a leakage from the opposite face of the backplate or from side walls of backplate perforation holes. Accordingly, these microphone systems may still be susceptible to current leaks and any resulting deteriorations in performance.

Alternatively, the membrane itself may be covered in one or more insulating layers, thereby potentially preventing current leaks. However, the placement of insulating layers on the membrane may impact the mechanical properties of the membrane, which should be sufficiently flexible in order to accurately capture sound wave vibrations. Consequently, this approach may lead to limited sensitivity of process-induced sensitivity variances. Furthermore, leakage between a back plate and other parts of the sensor may still result in the above described performance degradations.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

As used herein, a "circuit" may be understood as any kind of a logic implementing entity, which may be special purpose circuitry or a processor executing software stored in a memory, firmware, or any combination thereof. Furthermore, a "circuit" may be a hard-wired logic circuit or a programmable logic circuit such as a programmable processor, for example a microprocessor (for example a Complex Instruction Set Computer (CISC) processor or a Reduced Instruction Set Computer (RISC) processor). A "circuit" may also be a processor executing software, for example any kind of computer program, for example a computer program using a virtual machine code such as for example Java. Any other kind of implementation of the respective functions which will be described in more detail below may also be understood as a "circuit". It may also be understood that any two (or more) of the described circuits may be combined into one circuit.

According to various aspects of this disclosure, the conductive sections of the one or more backplates may be fully or partially encapsulated in insulating material in order to prevent current leakage between the backplate and membrane electrodes. Proper placement of insulating material may reduce or avoid such leakage caused by contaminants such as moisture, residues, or other particles.

As previously detailed, current capacitive microphones may have backplates with insulating material disposed on the surface of the backplate facing the membrane. However, such systems are still susceptible to contaminants that cause current leaks by becoming lodged between the opposite, uninsulated surface of the backplate and the membrane. Leakage paths may also be generated between contaminants that become stuck between conductive sidewalls of perforation holes formed in the backplate and the membrane. Accordingly, disposing further insulating materials on the vulnerable surfaces of the backplates may reduce or fully eliminate adverse effects caused by such leakage paths.

Figure 1:
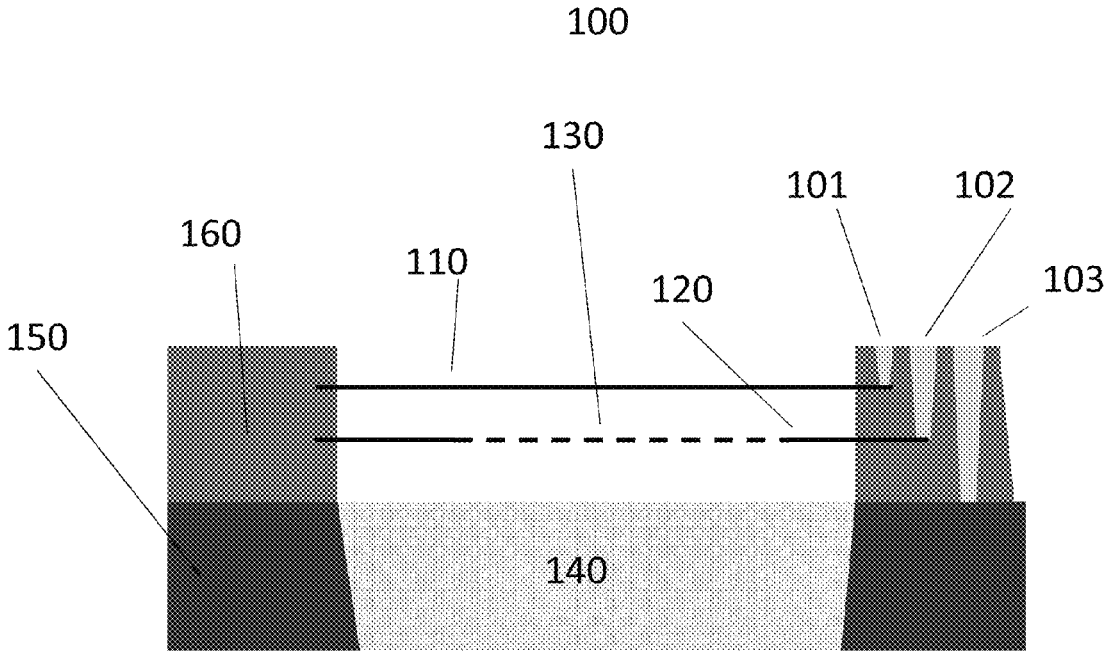
FIG. 1 shows a single backplate capacitive microphone system.

FIG. 1 shows capacitive microphone system 100. Capacitive microphone system 100 may include membrane 110, lower backplate 120, backplate perforation holes 130, opening cavity 140, substrate 150, support layer 160, and electrical contacts 101-103. Capacitive microphone system 100 may accordingly be a single backplate capacitive microphone system. Membrane 110 may be separated from lower backplate 120 by an air gap, as shown in FIG. 1. Opening cavity 140 may be formed in substrate 150, which may be a wafer substrate made of silicon. Sound waves may enter through opening cavity 140 and contact membrane 110. Membrane 110 may be substantially flexible, and may consequently undergo vibrations caused by incident sound waves. Lower backplate 120 may be structurally rigid, and may remain substantially stationary as sound waves pass through backplate perforation holes 130.

Membrane 110 and lower backplate 120 may be electrically connected to one of electrical contacts 101-103, which may be formed in support layer 160. Support layer 160 may be made of insulating material, and may also be used to mount and provide support to membrane 110 and lower backplate 120. A bias voltage may be provided to membrane 110 and lower backplate 120 via electrical contacts 101-103, thereby creating an electrical field between membrane 110 and lower backplate 120. The bias voltage may be supplied by a component such as e.g. an Application Specific Integrated Circuit (ASIC), as will be later described regarding FIG. 3. An ASIC may also provide a voltage to substrate 1150 through one of electrical contacts 101-103.

Membrane 110 and lower backplate 120 therefore may form a capacitor with a capacitance that varies as the membrane 110 vibrates. The vibrations of membrane 110 may effectively change the distance between the conductive plates formed by membrane 110 and lower backplate 120 while the charge on the capacitor remains nearly constant. Any resulting variances in capacitance may be detected by observing a change in voltage across the capacitor, which may vary above and below a supplied bias voltage. Capacitive microphone system 100 may accordingly transduce sound waves incident upon membrane 110 by monitoring changes in voltage through the use of a component such as e.g. an ASIC connected to electrical contacts 101-103.

Alternatively, capacitive microphone system 100 may include an upper backplate (not shown) instead of lower backplate 120. An upper backplate may be located on an opposite side of membrane 110 from lower backplate 120 as situated in FIG. 1.

Figure 2:
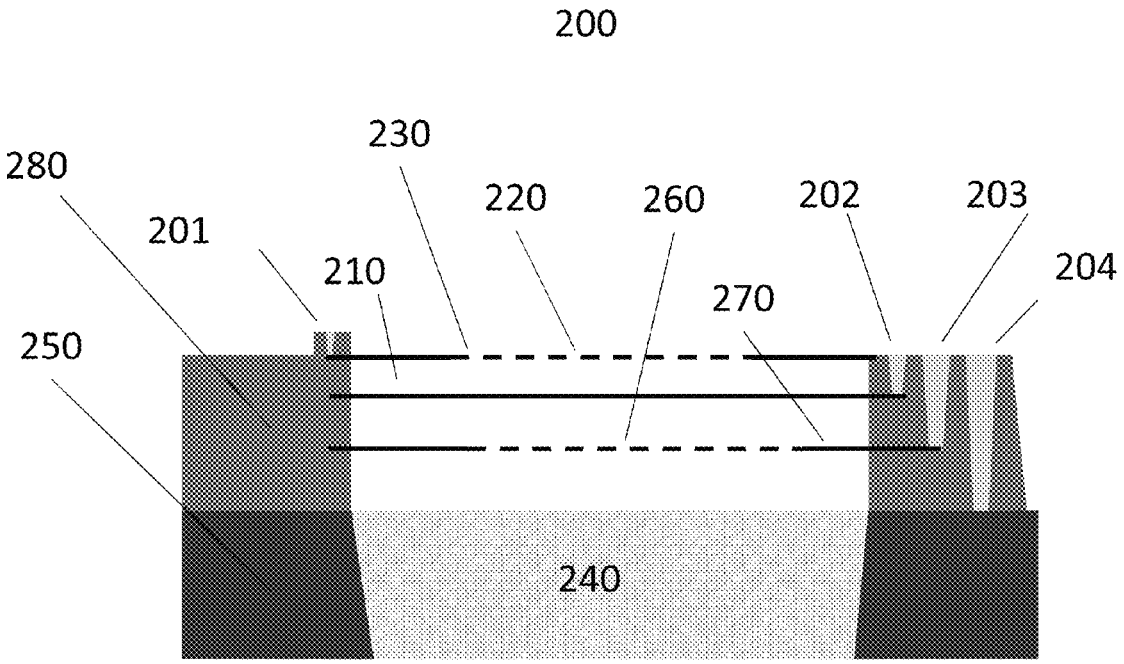
FIG. 2 shows a dual backplate capacitive microphone system.

FIG. 2 shows another capacitive microphone system 200. In contrast to capacitive microphone system 100 of FIG. 1, capacitive microphone system 200 may include two backplates (upper backplate 230 and lower backplate 270), and accordingly may be a dual backplate capacitive microphone. Capacitive microphone system 200 may also include membrane 210, upper backplate perforation holes 230, lower backplate perforation holes 260, opening cavity 240, substrate 250, support layer 280, and electrical contacts 201-204. An external component such as an ASIC may provide a bias voltage across membrane 210, upper backplate 220, and lower backplate 270 via electrical contacts 201-204. An ASIC may also provide a voltage to substrate 250. Similar to capacitive microphone system 100, membrane 210 may undergo vibrations caused by incident sound waves. Accordingly, the respective capacitances between membrane 210 and upper backplate 220 and between membrane 210 and lower backplate 270 may vary as the distance between membrane 210 and the backplates fluctuates. Any variations in capacitance may be detected in the form of voltage fluctuations by an external component such as ASIC that is also connected to electrical contacts 201-204. As in capacitive microphone system 100, the fluctuating voltage measurements may be used to transduce the sound waves incident on membrane 210 into electrical signals.

Figure 3:
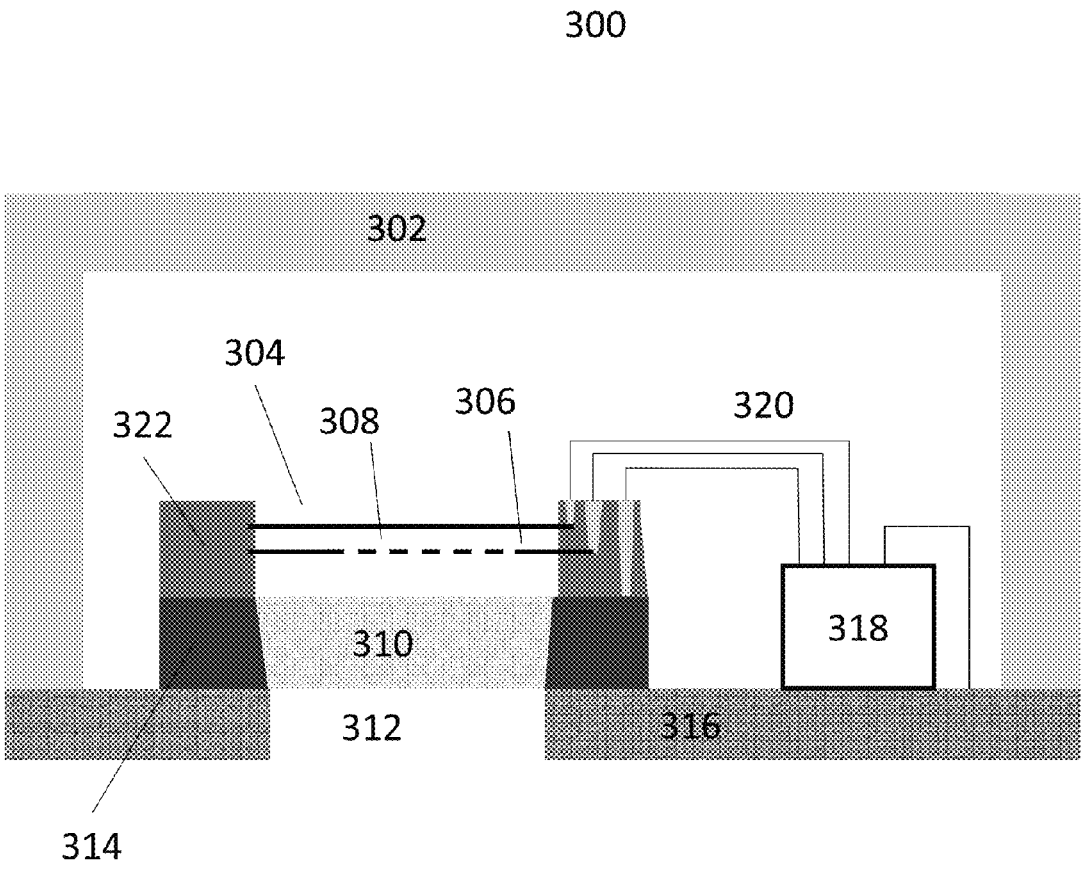
FIG. 3 shows a silicon capacitive microphone system.

FIG. 3 illustrate silicon capacitive microphone system 300. Silicon capacitive microphone system 300 may include cap structure 302, membrane 304, backplate 306, backplate perforation holes 308, opening cavity 310, sound port 312, first substrate 314, second substrate 316, ASIC 318, support layer 322, and wire bonds 320. Silicon capacitive microphone system 300 may be formed out of a silicon wafer according to silicon wafer etching techniques.

Silicon capacitive microphone system 300 is illustrated as having only a lower backplate (backplate 306), and accordingly may be a single backplate capacitive microphone similar in operation to capacitive microphone system 100. Alternatively, an upper backplate may also be provided (not shown) above membrane 304, in which case silicon capacitive microphone system 300 may function as a dual backplate capacitive microphone such as in capacitive microphone system 200.

Cap structure 302 may function as a housing, and may form a protective structure around the internal components of silicon capacitive microphone system 300. Cap structure 302 may have an opening at sound port 312, which may be formed through second substrate 316. Sound waves may enter into silicon capacitive microphone system 300 through sound port 312, and pass through opening cavity 310 formed in first substrate 314. Sound waves accordingly may contact membrane 304, thereby causing membrane 304 to vibrate. As detailed regarding capacitive microphone system 100, a bias voltage may be supplied across membrane 304 and backplate 306 via electrical contacts (not labeled) connected to wire bonds 320, thereby effectively forming a capacitor using membrane 304 and backplate 306 as conductive plates. Sound waves may be accordingly transduced into electrical signals by observing variations across the capacitive electrodes (membrane 304 and backplate 306). ASIC 318 may be utilized to provide a bias voltage to membrane 304 and backplate 306, and accordingly may also measure any voltage fluctuations in order to transduce sound waves entering through sound port 312 into electrical signals. ASIC 318 may also provide a voltage to first substrate 314, and may similarly receive an external power supply through second substrate 316.

Alternatively, silicon capacitive microphone system 300 may include an upper backplate (not shown) instead of backplate 306. An upper backplate may be located on an opposite side of membrane 304 from backplate 306 as situated in FIG. 3.

Figure 4:
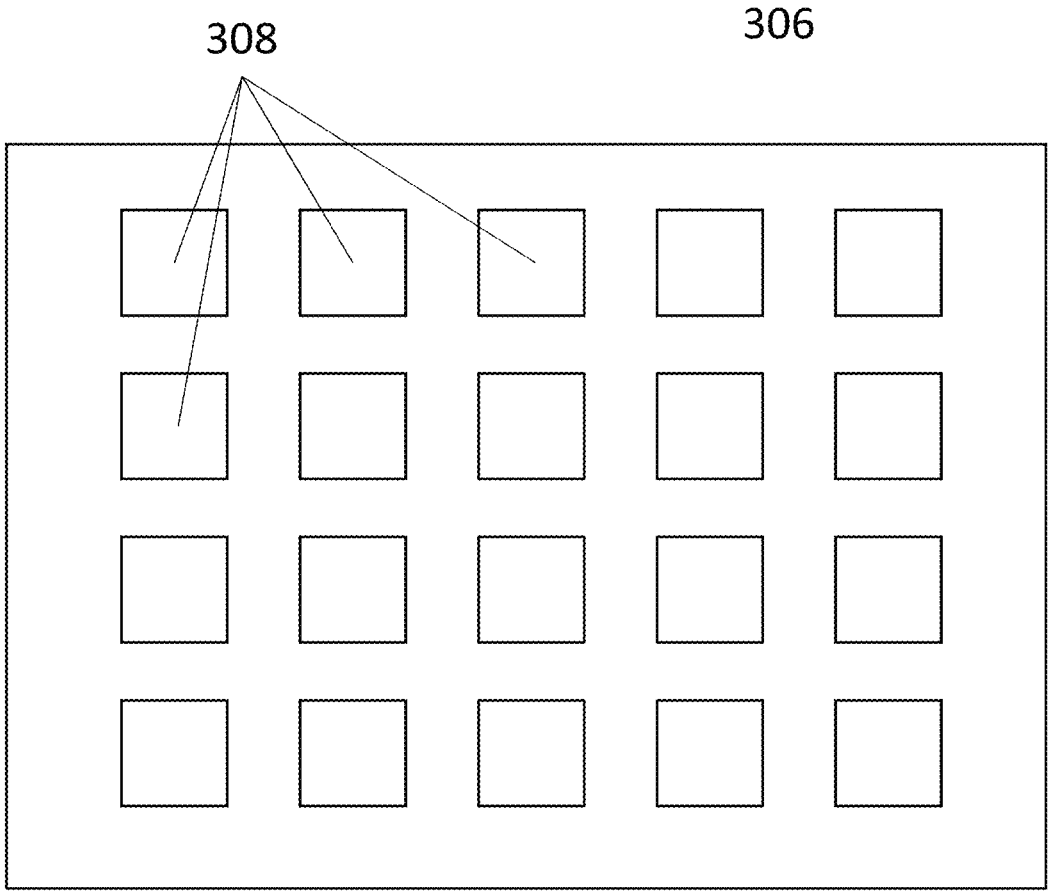
FIG. 4 shows a plan view of a perforated backplate.

FIG. 4 shows an exemplary plan view of backplate 306. A plurality of backplate perforation holes 308 may be formed in backplate 306. Each of backplate perforation holes 308 may be of a substantially similar size and shape, as shown in FIG. 4. In an embodiment, each of backplate perforation holes 308 may be e.g. approximately an 8 μm opening. Alternatively, each of backplate perforation holes 308 may be of substantially different sizes and shapes. Additionally, each of backplate perforation holes 308 may be oriented in a symmetrical, grid-like manner as shown in FIG. 4. In an embodiment, each of backplate perforation holes 308 may be spaced approximately 0.7 μm apart. Alternatively, each of backplate perforation holes 308 may be spread in a non-symmetrical fashion across backplate 306. Many such variations are possible, and the illustrated embodiments are not limiting in this respect.

Figure 5:
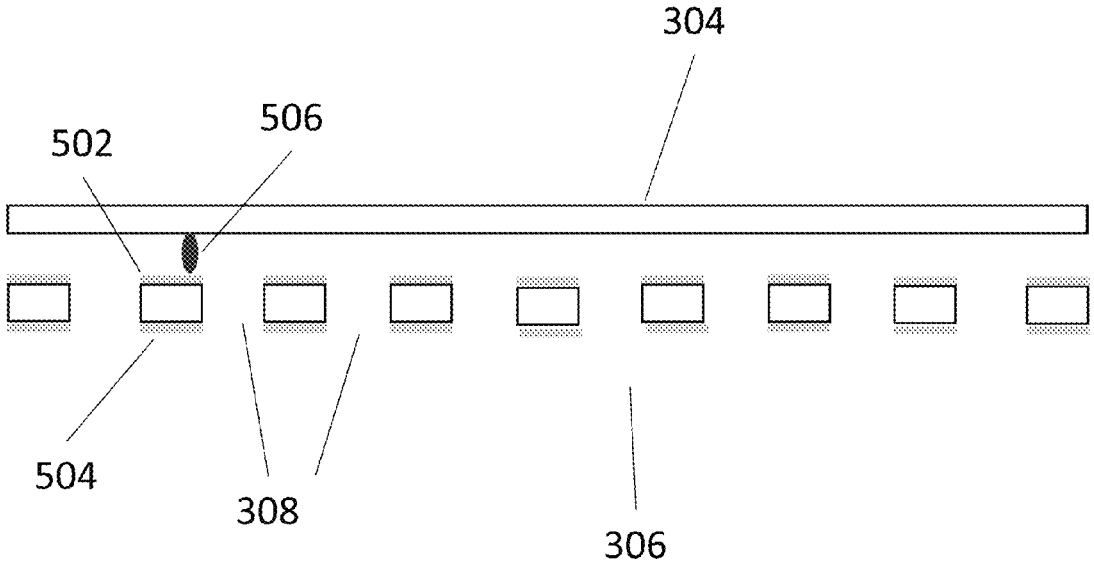
FIG. 5 shows a cross-sectional view of a perforated backplate and membrane.

FIG. 5 shows a cross-sectional view of membrane 304 and backplate 306 including backplate perforation holes 308. As shown in FIG. 5, top insulating layer 502 and bottom insulating layer 504 may be disposed on the top and bottom surfaces of backplate 306. The application of insulating layers 502 and 504 may prevent current leaks between membrane 304 and backplate 306, as will now be described.

For example, contaminant particle 506 may become lodged between backplate 306 and membrane 304. Contaminant particle 506 may be e.g. moisture, residue, or other similar particles that silicon capacitive microphone system 300 may be exposed to.

As shown in FIG. 5, top insulating layer 502 may form a physical bather between contaminant particle 506 and backplate 306. Accordingly, a current leak between membrane 304 and backplate 306 may be substantially prevented or contained. Silicon capacitive microphone system 300 may consequently lower the probability of occurrence and the negative impact of current leaks between the capacitive electrodes membrane 304 and backplate 406. Current leaks between membrane 304 and backplate 306 may lead to reduced sensitivity, increased noise, and/or increased current consumption.

Bottom insulating layer 504 may be disposed on the bottom surface of backplane 306. This additional layer of insulation may further protect silicon capacitive microphone system 300 from current leaks, such as e.g. from particles that form a current leak between the bottom surface of backplate 306 and membrane 304.

Figure 6:
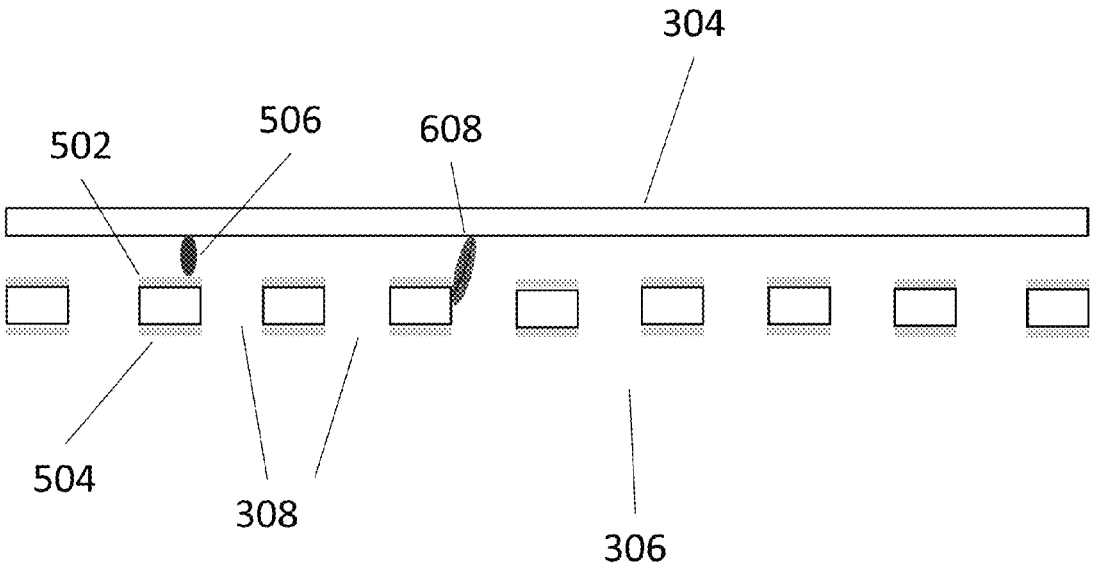
FIG. 6 shows a cross-sectional view of a perforated backplate and membrane.

Despite the additional protection offered by encapsulating the top and bottom surfaces of backplate 306 with insulating layers 502 and 504, silicon capacitive microphone system 300 may still be susceptible to current leaks. FIG. 6 illustrates an exemplary scenario where a current leak is formed with a leakage path extending from one or more sidewalls of backplate perforation holes 308. As shown in FIG. 6, contaminant particle 608 may become lodged between backplate 306 and membrane 304. Contaminant particle 608 may contact a sidewall of one of backplate perforation holes 308 formed in backplate 306, which may not be covered by insulation and is an exposed conductive face. Accordingly, a current leakage path may be formed through contaminant particle 608 from backplate 306 to membrane 304.

Figure 7:
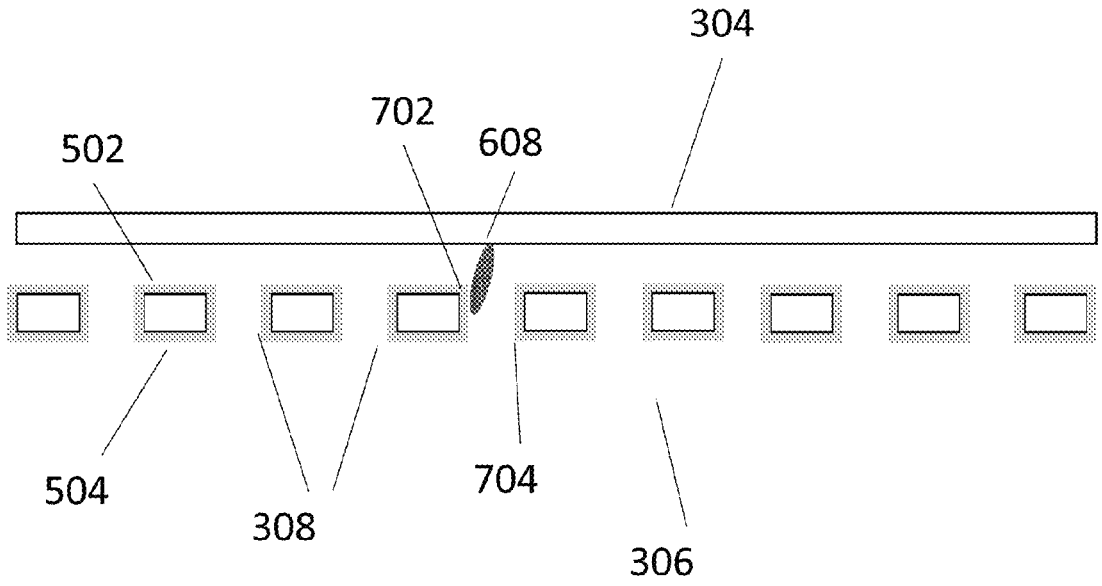
FIG. 7 shows a cross-sectional view of a perforated backplate and membrane.

As shown in FIG. 7, leakage paths from a sidewall of one of backplate perforation holes 308 may be prevented by covering the sidewalls of backplate perforation holes 308 with sidewall insulating layers 702 and 704. Sidewall insulating layers 702 and 704 may alternatively partially or fully cover one or more of the sidewalls of backplate perforation holes 308, thereby preventing contaminant particle 608 from supporting a leakage path to membrane 304. Accordingly, part or all of the exposed conductive surfaces of backplate perforation holes 308 may be covered in insulating material. As shown in FIG. 7, this placement of insulating material may further prevent current leaks.

FIG. 7 illustrates an embodiment where backplate 306 may be fully encapsulated in insulating material by insulating layers 502, 504, 702, and 704. In exemplary scenarios, fully encapsulating backplate 306 may provide effective protection from current leaks caused by contaminant particles such as contaminant particles 506 and 608. In various embodiments, insulating material may be disposed so as to completely cover every sidewall of every backplate perforation hole 308 formed in backplate 306. Insulating material may additionally be disposed to completely encapsulate both the top and bottom surfaces of backplate 306. Accordingly, backplate 306 may be completely encapsulated in insulating material. Alternatively, insulating material may only be disposed on surfaces of backplate 306 that are conductive.

Backplate 306 may be formed of a conductive material such as silicon. Backplate 306 may also be formed of doped polysilicon (amorphous or crystalline), metal, silicide, carbide, or one or more carbon layers. Backplate 306 may have a thickness of e.g. around 300 nm, such as e.g. 330 nm. Alternatively, backplate 306 may range from several nm thick, such as e.g. for a metal backplate, to around 2 μm thick.

The insulating layers disposed on backplate 306 may be approximately 140 nm thick. By way of example, the insulating layers may range from e.g. several nm thick to e.g. 200-300 nm thick to e.g. 500 nm thick. In an embodiment, different regions of the insulating layers disposed on backplate 306 may have different thicknesses. For example, top insulating layer 502 on the top surface of backplate 306 may have a different thickness than bottom insulating layer 502 or one of sidewall insulating layers 704 or 702. In a further embodiment, the thickness of different regions of the insulating layers may be selected based on the regions of backplate 306 that are most vulnerable to current leaks. For example, top insulating layer 502 may be selected to have a higher thickness than bottom insulating layer 504.

Figure 8:
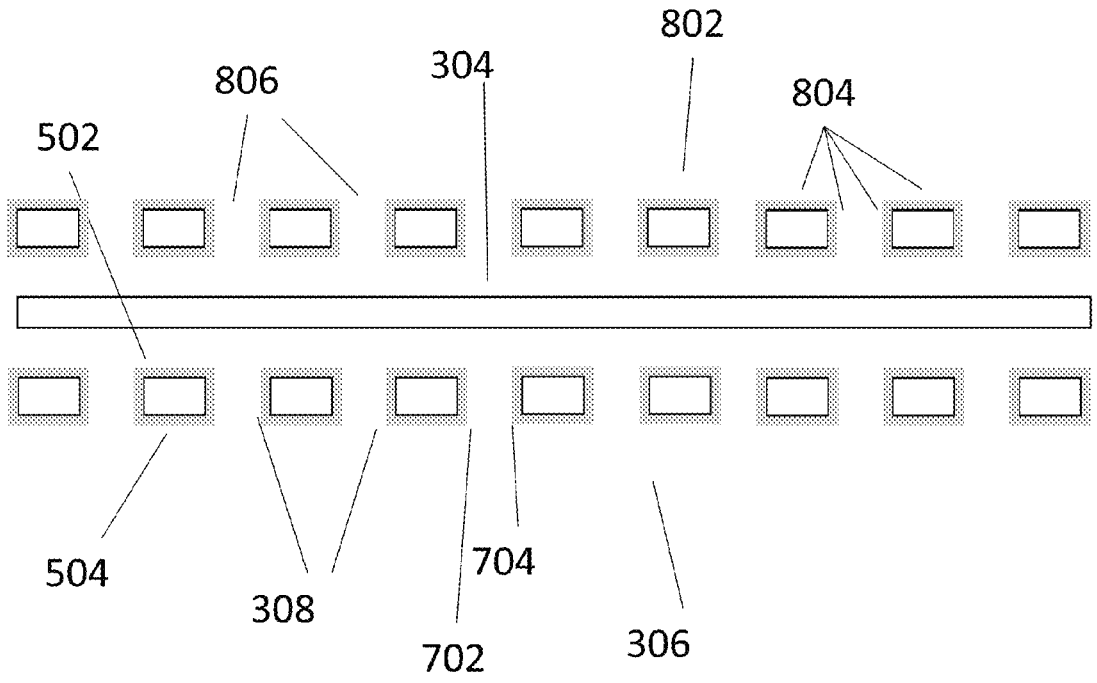
FIG. 8 shows a cross-sectional view of a perforated backplate and membrane.

Silicon capacitive microphone system 300 may additionally include upper backplate 802 that is disposed on the opposite side of membrane 304 as backplate 306, as shown in FIG. 8. Upper backplate 802 may additionally have insulating layers such as upper backplate insulating layers 804 disposed on one or more surfaces of upper backplate 802. As shown in FIG. 8, one or more of upper backplate insulating layers 804 may be disposed on a sidewall of one of upper backplate perforation holes 806. One or more of upper backplate insulating layers 804 may additionally be disposed on a top surface of upper backplate 802 and/or a bottom surface of upper backplate 802. As illustrated in FIG. 8, upper backplate 802 may be fully encapsulated with upper backplate insulating layers 804 in a similar manner as to backplate 306. Similarly, the relative placements as well as thickness of upper backplate insulating layers 804 may vary.

Accordingly, encapsulating both upper backplate 802 and backplate 306 with insulating layers such as shown in FIG. 8 may reduce or prevent adverse effects caused by current leakage paths through contaminant particles. The robustness of a dual backplate capacitive microphone to current leaks may consequently be improved through proper placement of insulating layers.

Numerous variations in the placement of insulating layers are additionally possible. For example, backplate 306 of FIG. 3 may only be partially encapsulated in insulating material. Accordingly, insulating material may be only disposed on some of the sidewalls of backplate perforation holes 308 formed in backplate 306, and consequently some sidewalls of backplate perforation holes may be unprotected by insulating material. This may reduce manufacturing costs while still maintaining a substantial degree of protection from current leaks due to the sidewalls that remain covered.

Additionally, insulating layers disposed on sidewalls of backplate perforation holes 308 formed in backplate 306 may not cover the entire surface of the sidewalls. For example, insulating layers may only cover a section of sidewall that is closest to membrane 304. Similarly to as described above, manufacturing costs may be reduced due to decreased insulating material requirements while still maintaining a high degree of protection due to the partial encapsulation of backplate 306.

Capacitive microphone system 300 may therefore include a housing (e.g. 302), a membrane (e.g. 304), and a first backplate (e.g. 306). A first insulating layer may be disposed on a first side of the first backplate facing the membrane. A second insulating layer may be disposed on a second side of the first backplate opposite to the first side of the first backplate.

The first backplate may be located on an opposite side of the membrane from a sound port formed in the housing. The first backplate may alternatively be located on the same side as a sound port formed in the housing.

The first backplate may also be perforated, and accordingly may have a plurality of perforation holes formed from the top side of the first backplate to the bottom side of the first backplate.

In an embodiment, further insulating layers (e.g. 704 and/or 702) may be disposed on each conductive surface of the first backplate. Each conductive surface of the first backplate may be completely covered with insulating material, such as e.g. further insulating layers.

A further insulating layer may be disposed on a side wall of at least one of a plurality of perforation holes (e.g. 308) in the first backplate. In a further embodiment, each of the side walls of at least one of the plurality of perforation holes in the first backplate may be covered with insulating material. Each conductive surface of each of the side walls of one or more of the plurality of perforation holes in the first backplate may be completely covered with insulating material. Each of the side walls of each of the perforation holes in the first backplate may be completely covered with insulating material. Accordingly, each conductive surface of the backplate may be completely covered with insulating material.

The capacitive microphone may also include a second backplate (e.g. 802 as detailed regarding upper backplate 230 of FIG. 2). The second backplate may be disposed on an opposite side of the membrane from the first backplate.

A further insulating layer (e.g. 804) may be disposed on either a first side of the second backplate or on the second side of the second backplate. Alternatively, further insulating layers (e.g. 804) may be disposed on both the first side of the second backplate and the second side of the second backplate, where the second side is on an opposite side of the second backplate from the first side of the second backplate.

A further insulating layer (e.g. 804) may be disposed on an outer wall of at least one of a plurality of perforation holes in the second backplate. Each conductive surface of the second backplate may be completely covered with insulating material. Each conductive surface of both the first backplate and the second backplate may be completely covered with insulating material.

The capacitive microphone may further include a circuit (e.g. 318) configured to provide a bias voltage to the membrane, the first backplate, and/or the second backplate (if present).

The capacitive microphone may be a capacitive silicon microphone. The first backplate may be composed of doped silicon, doped polysilicon, metal, silicide, carbide, or one or more carbon layers.

The membrane may also be composed of doped silicon, doped polysilicon, metal, silicide, carbide, or one or more carbon layers or any other suitable material.

The first insulating layer may be composed of silicon nitride, silicon oxide, or a dielectric material. The additional insulating layers and materials may also be composed of silicon nitride, silicon oxide, or a dielectric material.

The capacitive microphone may also be an electret condenser microphone. Accordingly, the membrane or one of the backplates may be composed of an electret material, while the other may be covered in insulating material in order to prevent current leaks.

Alternatively, the capacitive microphone may include a membrane and a first perforated backplate, wherein an insulating layer is disposed on an outer wall of one of a plurality of perforation holes in the first perforated backplate. The first perforated backplate may be located on an opposite side of the membrane from a sound port formed in a housing provided around the membrane and the first perforated backplate. The first perforated backplate may alternatively be located on the same side as a sound port formed in a housing provided around the membrane and the first perforated backplate.

Further insulating layers may be disposed on each outer wall of at least one of the plurality of perforation holes in the first perforated backplate. Each conductive surface of the first perforated backplate may be completely covered with insulating material.

A first insulating material may be disposed on a first side of the first perforated backplate, where the first side of the first perforated backplate faces the membrane. A second insulating layer may be disposed on a second side of the first perforated backplate, where the second side of the first perforated backplate is on an opposite side of the first perforated backplate from the first side. Accordingly, each conductive surface of the first perforated backplate may be completely covered with insulating material.

The capacitive microphone may include a second perforated backplate. Accordingly, an outer wall of one of a plurality of perforation holes in the second perforated backplate may be covered with insulating material. Insulating material may additionally be disposed on either a first side of the second perforated backplate or on a second side of the second perforated backplate, where the second side of the second perforated backplate is on an opposite side from the first side. Insulating material may be disposed on both the first side of the second perforated backplate and the second side of the second perforated backplate. Each conductive surface of the second perforated backplate may be completely covered with insulating material.

The capacitive microphone may be a capacitive silicon microphone. Accordingly, the first backplate and/or the second backplate (if present) may be composed of doped silicon, doped polysilicon, metal, silicide, carbide, or one or more carbon layers. The membrane may also be composed of doped silicon, doped polysilicon, metal, silicide, carbide, or one or more carbon layers. The first insulating layer in addition to any further present insulating material may be composed of silicon nitride, silicon oxide, or a dielectric material.

The capacitive microphone may further include a circuit configured to provide a bias voltage to the membrane and the first and/or second backplate (if present).

The capacitive microphone may be an electret condenser microphone.

Figure 9:
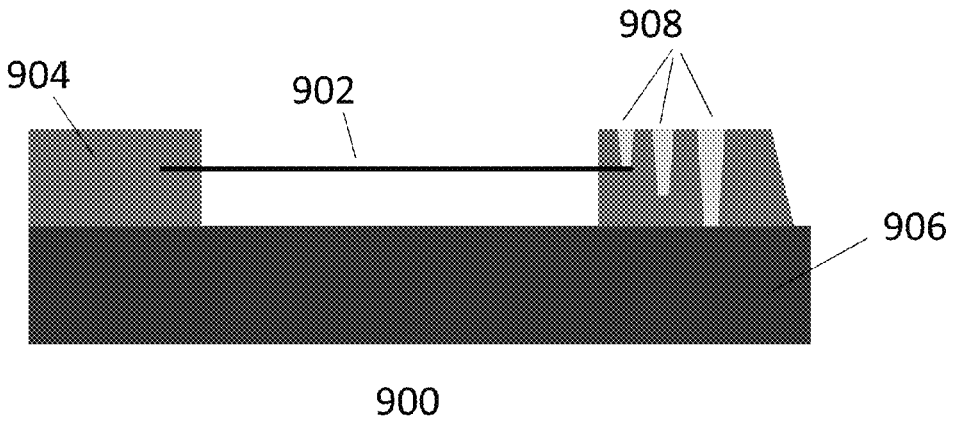
FIG. 9 shows a capacitive pressure sensor system.

FIG. 9 shows capacitive pressure sensor system 900 according to a further embodiment. Capacitive pressure sensor system 900 may include conductive substrate 906 and membrane 902. Capacitive pressure sensor system 900 may also include electrical contacts 908, which may be formed in support layer 904. Electrical contacts 908 may be connected to an external electrical component such as e.g. an ASIC. A connected ASIC may provide a bias voltage to membrane 902 and conductive substrate 906. An applied bias voltage may create an electrical field between membrane 902 and conductive substrate 906, and consequently may realize a capacitive system with membrane 902 and conductive substrate 906 as electrodes.

Pressure waves incident upon membrane 902 may cause membrane 902 to vibrate, thus altering the distance between membrane 902 and conductive substrate 906. Capacitive pressure sensor system 900 may accordingly experience fluctuations in capacitance between membrane 902 and conductive substrate 906, which may be observed by monitoring an output voltage at electrical contacts 908. Pressure waves may therefore be measured by a component such as an ASIC connected to electrical contacts 908, and may accordingly be transduced into an electrical signal.

Similar to the above-described capacitive microphone systems, contaminant particles may become lodged between the conductive plates (membrane 902 and conductive substrate 906), thereby causing a current leak. A current leak may negatively impact the performance of capacitive pressure sensor system 900 by reducing sensitivity, increasing noise, and increased current consumption.

Figure 10:
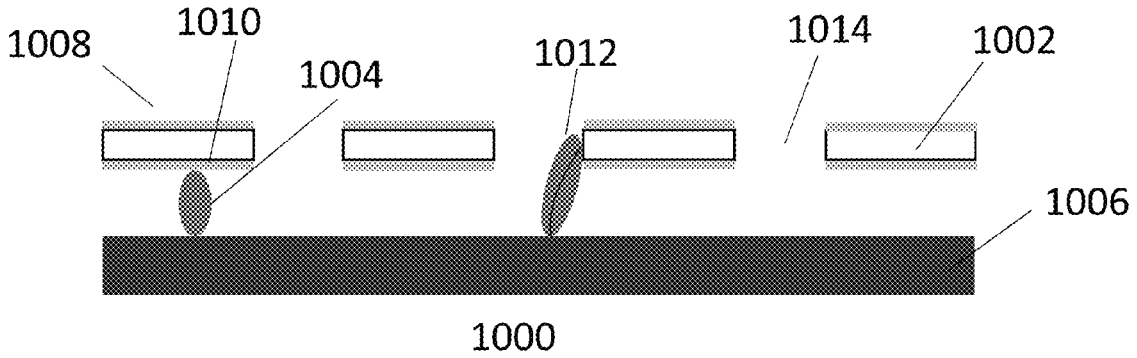
FIG. 10 shows a cross-sectional view of a capacitive pressure sensor system.

FIG. 10 shows capacitive pressure sensor system 1000. Capacitive pressure sensor system 1000 may include conductive substrate 1006 and membrane 1002. Membrane 1002 may be perforated, as shown in FIG. 10, and accordingly may have one or more membrane perforation holes 1014. Alternatively, membrane 1002 may not be perforated, and may consequently be completely enclosed (not shown).

As shown in FIG. 10, a first insulating layer 1008 may be disposed on a top side of membrane 1002 facing away from conductive substrate 1006. A second insulating layer 1010 may be disposed on a bottom side of membrane 1002 opposite to the top side of membrane 1002 facing conductive substrate 1006. Accordingly, the presence of first insulating layer 1008 and second insulating layer 1010 may prevent current leaks caused by contaminant particles. As shown in FIG. 10, contaminant particle 1004 may become lodged between a section of membrane 1002 and conductive substrate 1006. However, second insulating layer 1010 may be disposed on a bottom side of membrane 1002, and may prevent a current leak from forming between membrane 1002 and conductive substrate 1006. Current leaks from a top side of membrane 1002 directly to substrate 1006 may similarly be prevented by the presence of second insulating layer 1008.

As shown in FIG. 10, capacitive pressure sensor system 1000 may still be susceptible to current leaks from a side wall of one or more perforation holes 1014 in membrane 1002. Contaminant particle 1012 may become lodged between membrane 1002 and conductive substrate 1006, and may accordingly cause a current leak from an exposed conductive sidewall of a perforation hole 1014 in membrane 1002.

Figure 11:
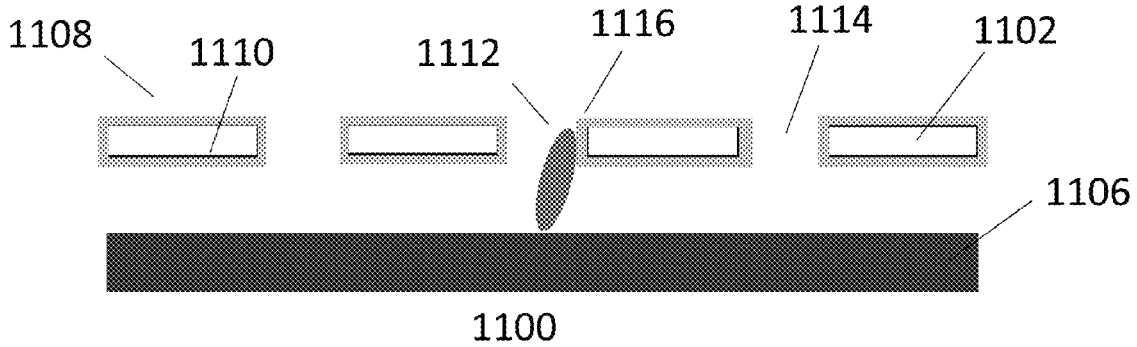
FIG. 11 shows a cross-sectional view of a capacitive pressure sensor system.

A further insulating layer (e.g. 1116) may therefore be disposed on a side wall of at least one of a plurality of perforation holes (e.g. 1114) of the membrane (e.g. 1102), as shown in FIG. 11. As a result, a potential current leak caused by particle 1112 between membrane 1102 and conductive substrate 1106 may be prevented.

In order to further prevent current leaks, each of the side walls of one of the plurality of perforation holes in the membrane may be covered by insulating material (e.g. 1116). Further insulating surfaces may be disposed on each conductive surface of the membrane. In a further exemplary embodiment, each conductive surface of the membrane may be completely covered by insulating material.

The capacitive pressure sensor of capacitive pressure sensor system 1100 may be a silicon pressure sensor. Accordingly, the membrane (e.g. 1102) may be composed of doped silicon, doped polysilicon, metal, silicide, carbide, or one or more carbon layers. Similarly, the conductive substrate (e.g. 1106) may also be composed of doped silicon, doped polysilicon, metal, silicide, carbide, or one or more carbon layers. The first insulating layer (e.g. 1108) and the second insulating layer (e.g. 1110) may be composed of silicon nitride, silicon oxide, or a dielectric material.

Figure 12:
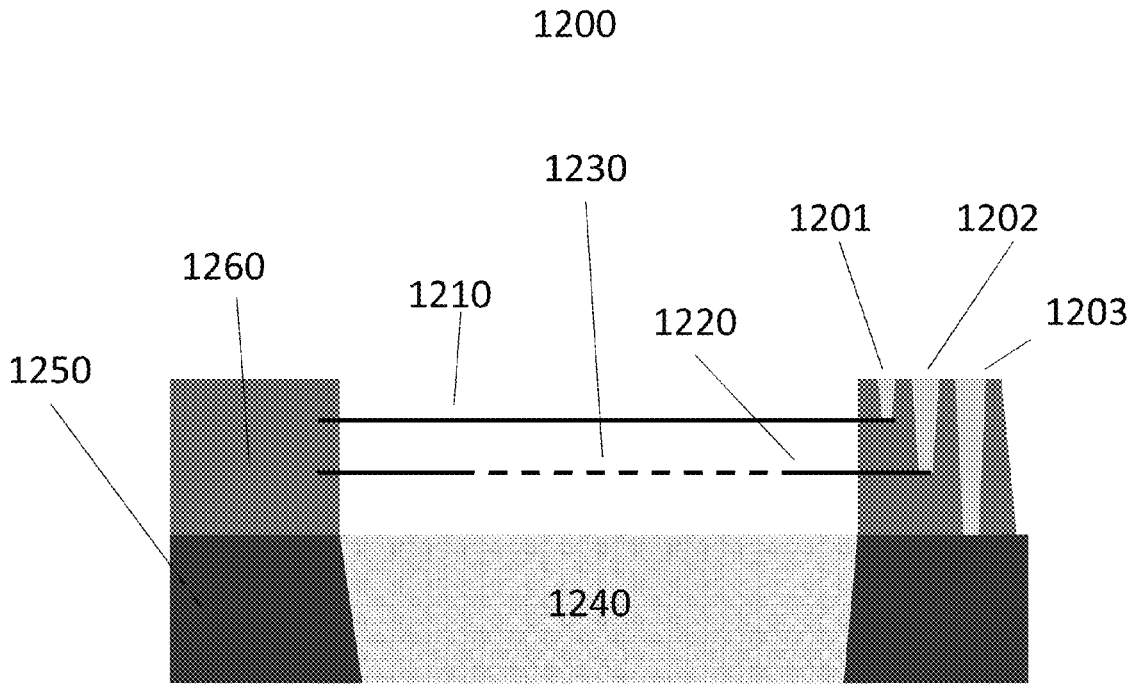
FIG. 12 shows a single backplate capacitive microspeaker system.

FIG. 12 shows capacitive microspeaker system 1200 according to a further exemplary embodiment. Capacitive microspeaker system 1200 may include membrane 1210, lower backplate 1220, backplate perforation holes 1230, opening cavity 1240, substrate 1250, support layer 1260, and electrical contacts 1201-1203. Electrical contacts 1201-1203 may be formed in support layer 1260, and may provide an external electrical signal to membrane 1210, lower backplate 1220, and substrate 1250. An external electrical signal may be provided by an external component such as e.g. an ASIC. An attached ASIC may provide a varying electrical signal, which may in turn adjust the electrical field between membrane 1210 and lower backplate 1220. These adjustments in electrical field may accordingly generate a force on conductive membrane 1210, causing it to be pushed or pulled relative to lower backplate 1220. These vibrations of membrane 1210 may cause sound waves, and accordingly capacitive microspeaker system 1200 may be used to transduce electrical signals into sound.

Capacitive microspeaker system 1200 may alternatively have an upper backplate (not shown) instead of lower backplate 1220. An upper backplate may be located on an opposite side of membrane 1210 from lower backplate 1220 as situated in FIG. 12.

Figure 13:
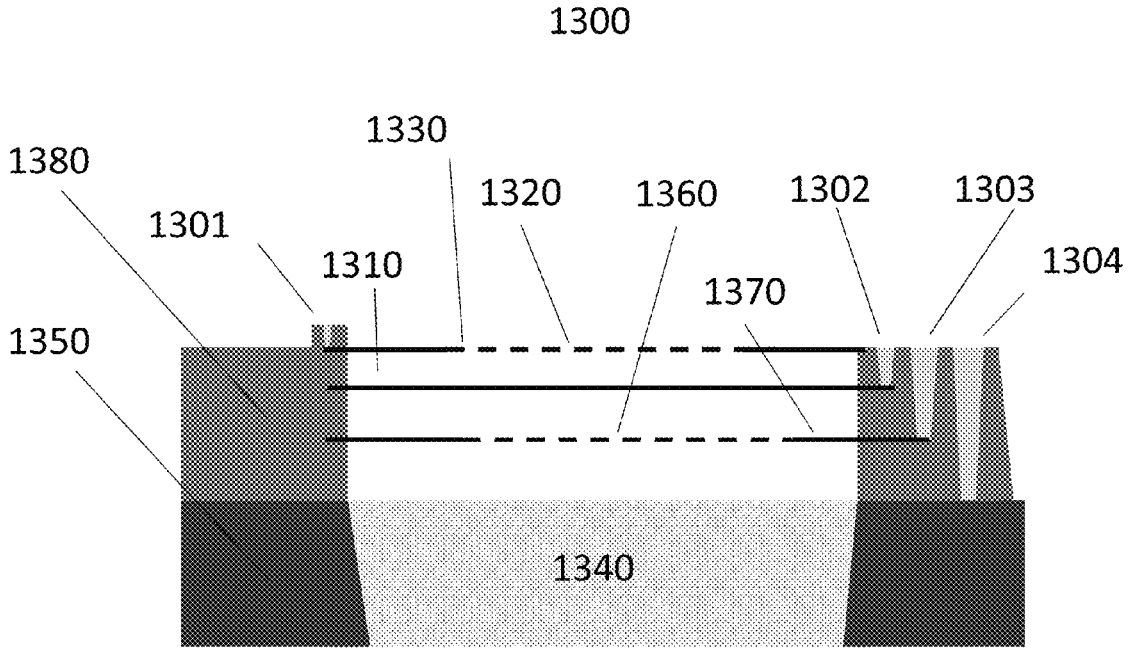
FIG. 13 shows a dual backplate capacitive microspeaker system.

FIG. 13 shows an embodiment of capacitive microspeaker system 1300 in which capacitive microspeaker system 1300 has both an upper backplate 1330 and lower backplate 1370. Upper backplate 1330 and lower backplate 1370 may be perforated and accordingly upper backplate perforation holes 1320 and lower backplate perforation holes 1360 may be formed upper backplate 1330 and lower backplate 1370, respectively. Capacitive microspeaker system 1300 may additionally include membrane 1310, opening cavity 1340, substrate 1350, and support layer 1380. Electrical contacts 1301-1304 may be formed in support layer 1380, and may be used to provide an external electrical signal to membrane 1310, upper backplate 1330, lower backplate 1370, and substrate 1350 from an external component such as an ASIC. Such an external electrical signal may generate an electric field between the aforementioned conductive components, and be used to transduce an electrical signal into sound waves by causing membrane 1310 to vibrate.

Figure 14:
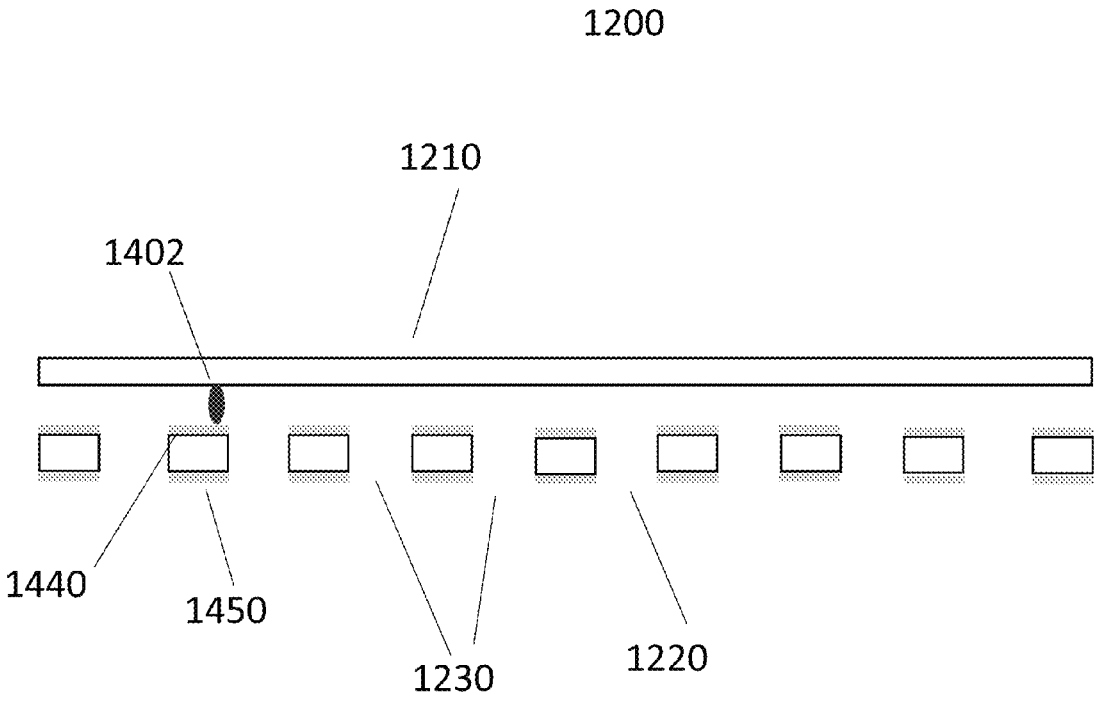
FIG. 14 shows a cross-sectional view of a capacitive microspeaker system.

Similarly as to the above described capacitive microphones and pressure sensors, the performance of capacitive microspeaker systems 1200 and 1300 may suffer from current leaks caused by contaminant particles. FIG. 14 shows an embodiment in which lower backplate 1220 of capacitive microspeaker system 1200 may be covered with insulating material in order to prevent or reduce current leaks stemming from contaminant particles. As shown in FIG. 14, first insulating layer 1440 and second insulating layer 1450 may be disposed on a top side of lower backplate 1220 and a bottom side of lower backplate 1220, respectively. Accordingly, first insulating layer 1440 and second insulating layer 1450 may prevent a current leak from being generated by contaminant particle 1402, which may become lodged between lower backplate 1220 and membrane 1210.

Figure 15:
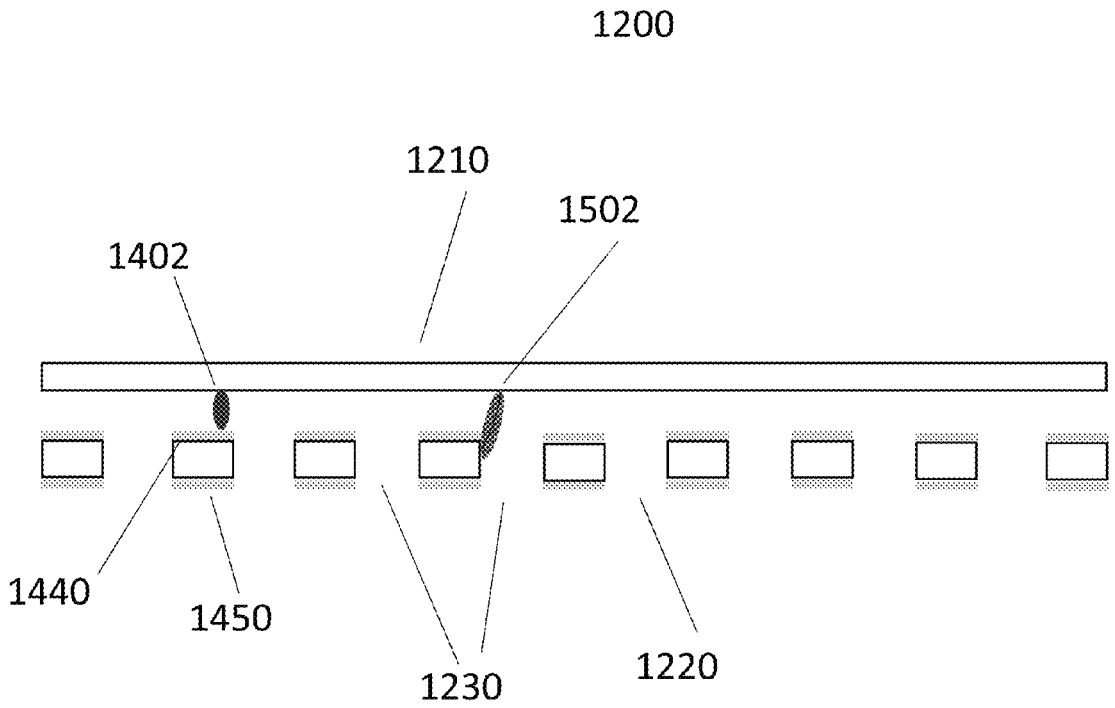
FIG. 15 shows a cross-sectional view of a capacitive microspeaker system.

However, as detailed in FIG. 15, contaminant particle 1502 may become lodged between lower backplate 1220 and membrane 1210 such that contaminant particle 0215 creates a current leak between a sidewall of one of a plurality of perforation holes 1230 in lower backplate 1220 and membrane 1210. Accordingly, performance of capacitive microspeaker system 1200 may suffer.

Figure 16:
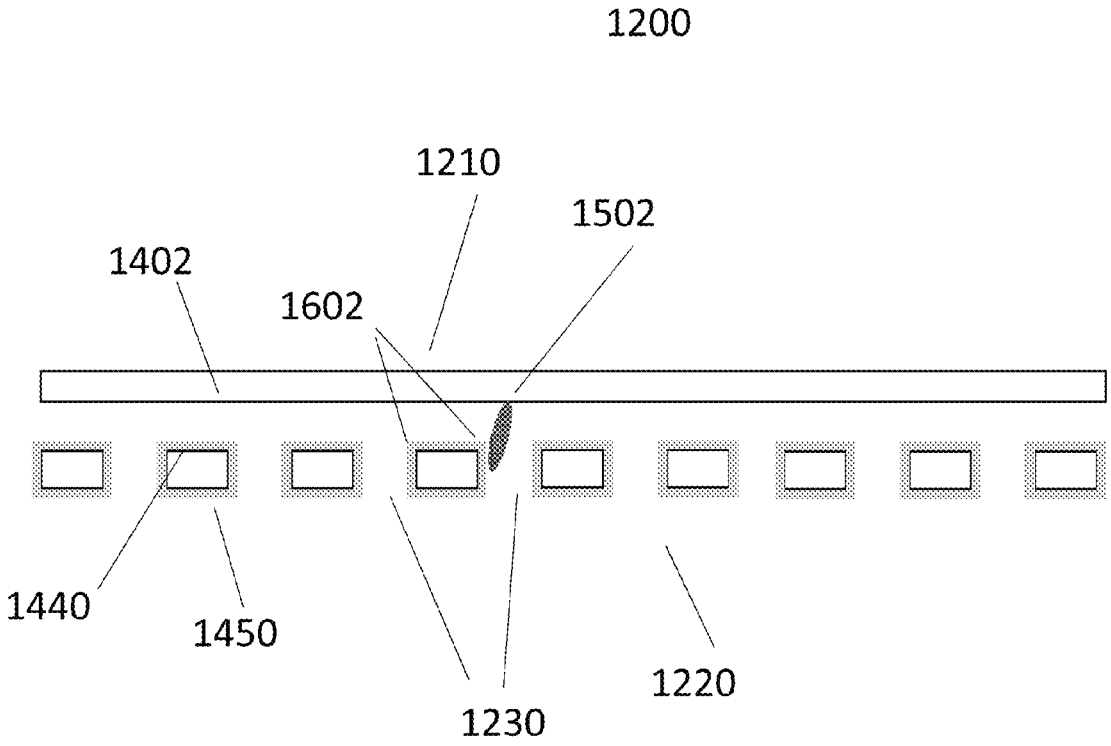
FIG. 16 shows a cross-sectional view of a capacitive microspeaker system.

Accordingly, further insulating layers 1602 may be disposed on a sidewall of one of perforation holes 1230 in lower backplate 1220, as shown in FIG. 16. Further insulating layers may prevent current leaks caused by contaminant particles such as contaminant particle 1502 by protecting the conductive surfaces of lower backplate 1220. At least one further insulating layer such as insulating layers 1602 may therefore be disposed on a side wall of at least one of the plurality of perforation holes 1230 in lower backplate 1220.

In a further embodiment, each of the side walls of one of the plurality of perforation holes (e.g. 1230) in lower backplate 1220 may be covered with insulating material. Further protection against current leaks may be offered by partially or fully covering each conductive surface of lower backplate 1220 with insulating material.

Capacitive microspeaker system 1200 may have an additional upper backplate such as detailed regarding capacitive microspeaker system 1300. Accordingly, capacitive microspeaker system 1200 may have an upper backplate that is encapsulated with insulating material in a similar manner to backplate 1220 in order to protect both backplates from current leaks.

Accordingly, a further insulating layer may be disposed on either a first side of the second backplate or a second side of the second backplate. In a further exemplary embodiment, a third insulating layer may be disposed on a first side of the second backplate facing the membrane and a fourth insulating layer may be disposed on a second side of the second backplate opposite to the first side of the second backplate.

A further insulating layer may be disposed on at least one side wall of at least one of a plurality of perforation holes in the second backplate.

The first backplate may be composed of doped silicon, doped polysilicon, carbide, or one or more carbon layers. The second backplate may also be composed of doped silicon, doped polysilicon, carbide, or one or more carbon layers.

Similarly, the membrane may be composed of doped silicon, doped polysilicon, carbide, or one or more carbon layers.

The first insulating layer, the second insulating layer, and/or any further insulating layers may be composed of silicon nitride, silicon oxide, or a dielectric material.

A capacitive microphone system according to an exemplary embodiment may therefore include a housing, a membrane, and a first backplate. A first insulating layer may be disposed on a first side of the first backplate facing the membrane. A second insulating layer may be disposed on a second side of the first backplate opposite to the first side of the first backplate.

The first backplate may be located on an opposite side of the membrane from a sound port formed in the housing. The first backplate may alternatively be located on the same side of the membrane from a sound port formed in the housing.

The first backplate may also be perforated. The first backplate may thus have a plurality of perforation holes formed from the first side of the first backplate to the second side of the first backplate.

In an embodiment, further insulating layers may be disposed on each conductive surface of the first backplate. Each conductive surface of the first backplate may be completely covered with insulating material, such as e.g. further insulating layers.

A further insulating layer may be disposed on a side wall of at least one of a plurality of perforation holes in the first backplate. In a further embodiment, each of the side walls of at least one of the plurality of perforation holes in the first backplate may be covered with insulating material. Each conductive surface of each of the side walls of one or more of the plurality of perforation holes in the first backplate may be completely covered with insulating material. Each of the side walls of each of the perforation holes in the first backplate may be completely covered with insulating material. Accordingly, each conductive surface of the backplate may be completely covered with insulating material.

The capacitive microphone may also include a second backplate. The second backplate may be disposed on an opposite side of the membrane from the first backplate.

A further insulating layer may be disposed on either a first side of the second backplate or on a second side of the second backplate. Alternatively, further insulating layers may be disposed on both the first side of the second backplate and the second side of the second backplate, where the second side is on an opposite side of the second backplate from the first side of the second backplate.

A further insulating layer may be disposed on an outer wall of at least one of a plurality of perforation holes in the second backplate. Each conductive surface of the second backplate may be completely covered with insulating material. Each conductive surface of both the first backplate and the second backplate may be completely covered with insulating material.

The capacitive microphone may further include a circuit configured to provide a bias voltage to the membrane, the first backplate, and/or the second backplate (if present).

The capacitive microphone may be a capacitive silicon microphone. The first backplate may be composed of doped silicon, doped polysilicon, metal, silicide, carbide, or one or more carbon layers.

The membrane may also be composed of doped silicon, doped polysilicon, metal, silicide, carbide, or one or more carbon layers or any other suitable material.

The first insulating layer may be composed of silicon nitride, silicon oxide, or a dielectric material. The additional insulating layers and materials may also be composed of silicon nitride, silicon oxide, or a dielectric material.

The capacitive microphone may also be an electret condenser microphone. Accordingly, the membrane or one of the backplates may be composed of an electret material, while the other may be covered in insulating material in order to prevent current leaks.

Alternatively, the capacitive microphone may include a membrane and a first perforated backplate, wherein an insulating layer is disposed on an outer wall of one of a plurality of perforation holes in the first perforated backplate. Further insulating layers may be disposed on each outer wall of at least one of the plurality of perforation holes in the first perforated backplate. Each conductive surface of the first perforated backplate may be completely covered with insulating material.

The first perforated backplate may be located on an opposite side of the membrane from a sound port formed in a housing provided around the membrane and the first perforated backplate. The first perforated backplate may alternatively be located on the same side of the membrane from a sound port formed in a housing provided around the membrane and the first perforated backplate.

A first insulating material may be disposed on a first side of the first perforated backplate, where the first side of the first perforated backplate faces the membrane. A second insulating layer may be disposed on a second side of the first perforated backplate, where the second side of the first perforated backplate is on an opposite side of the first perforated backplate from the first side. Accordingly, each conductive surface of the first perforated backplate may be completely covered with insulating material.

The capacitive microphone may include a second perforated backplate. Accordingly, an outer wall of one of a plurality of perforation holes in the second perforated backplate may be covered with insulating material. Insulating material may additionally be disposed on either a first side of the second perforated backplate or on a second side of the second perforated backplate, where the second side of the second perforated backplate is on an opposite side from the first side. Insulating material may be disposed on both the first side of the second perforated backplate and the second side of the second perforated backplate. Each conductive surface of the second perforated backplate may be completely covered with insulating material.

The capacitive microphone may be a capacitive silicon microphone. Accordingly, the first backplate and/or the second backplate (if present) may be composed of doped silicon, doped polysilicon, metal, silicide, carbide, or one or more carbon layers. The membrane may also be composed of doped silicon, doped polysilicon, metal, silicide, carbide, or one or more carbon layers. The first insulating layer in addition to any further present insulating material may be composed of silicon nitride, silicon oxide, or a dielectric material.

The capacitive microphone may further include a circuit configured to provide a bias voltage to the membrane and the first and/or second backplate (if present).

The capacitive microphone may be an electret condenser microphone.

A capacitive pressure sensor according to an exemplary embodiment may include a conductive substrate and a membrane.

A first insulating layer may be disposed on a first side of the membrane facing the conductive substrate. A second insulating layer may be disposed on a second side of the membrane opposite to the first side of the membrane.

A further insulating layer may be disposed on a side wall of at least one of a plurality of perforation holes in the membrane. Each of the side walls of one of the plurality of perforation holes in the membrane may be covered by insulating material. In a further exemplary embodiment, further insulating layers may be disposed on each conductive surface of the membrane. Each conductive surface of the membrane may be completely covered by insulating material.

The capacitive pressure sensor may be a silicon pressure sensor. The membrane may be composed of doped silicon, doped polysilicon, metal, silicide, carbide, or one or more carbon layers. The conductive substrate may be composed of doped silicon, doped polysilicon, metal, silicide, carbide, or one or more carbon layers. The first insulating layer and the second insulating layer may be composed of silicon nitride, silicon oxide, or a dielectric material.

A silicon microspeaker according to an exemplary embodiment may include a membrane and a first backplate. A first insulating layer may be disposed on a first side of the first backplate facing the membrane. A second insulating layer may be disposed on a second side of the first backplate opposite to the first side of the first backplate.

The first backplate may be located on an opposite side of the membrane from a sound port formed in a housing provided around the membrane and the first backplate. The first backplate may alternatively be located on the same side of the membrane from a sound port formed in a housing provided around the membrane and the first backplate.

A further insulating layer may be disposed on a side wall of at least one of a plurality of perforation holes in the first backplate.

Each of the side walls of one of the plurality of perforation holes in the first backplate may be covered with insulating material. Each conductive surface of the first backplate may be covered with insulating material. Each conductive surface of the first backplate may be completely covered by insulating material.

The silicon microspeaker may include a second backplate on an opposite side of the membrane from the first backplate. A further insulating layer may be disposed on either a first side of the second backplate or a second side of the second backplate.

Alternatively, a third insulating layer may be disposed on the first side of the second backplate facing the membrane and a fourth insulating layer may disposed on the second side of the second backplate opposite to the first side of the second backplate.

A further insulating layer may be disposed on at least one side wall of at least one of a plurality of perforation holes in the second backplate.

The first backplate may be composed of doped silicon, doped polysilicon, metal, silicide, carbide, or one or more carbon layers. The membrane may be composed of doped silicon, doped polysilicon, metal, silicide, carbide, or one or more carbon layers. The first insulating layer and the second insulating layer may be composed of silicon nitride, silicon oxide, or a dielectric material.

According to a further exemplary embodiment, a silicon microelectromechanical (MEMS) device may be provided. The silicon MEMS device may include a membrane and a first backplate, wherein a first insulating layer is disposed on a first side of the first backplate facing the membrane and a second insulating layer is disposed on a second side of the first backplate opposite to the first side of the first backplate.

The first backplate may be located on an opposite side of the membrane from a sound port formed in a housing provided around the membrane and the first backplate. The first backplate may alternatively be located on the same side of the membrane from a sound port formed in a housing provided around the membrane and the first backplate.

A further insulating layer may be disposed on a side wall of at least one of a plurality of perforation holes in the first backplate of the silicon MEMS device. Alternatively, each of the side walls of one or more of the plurality of perforation holes in the first backplane may be covered with insulating material. In a further exemplary embodiment, each conductive surface of the first backplate may be completely covered with insulating material.

The silicon MEMS device may be a capacitive silicon microphone. Alternatively, the silicon MEMS device may be a capacitive silicon microspeaker.

The first backplate of the silicon MEMS device may be composed of doped silicon, doped polysilicon, metal, silicide, carbide, or one or more carbon layers. The membrane may be composed of doped silicon, doped polysilicon, metal, silicide, carbide, or one or more carbon layers. The first insulating layer and/or any further insulating material may be composed of silicon nitride, silicon oxide, or a dielectric material.

In another embodiment, a silicon MEMS device may be provided that includes a membrane, a first perforated backplate, and an insulating layer disposed on at least one outer wall of one of a plurality of perforation holes in the first perforated backplate.

The first perforated backplate may be located on an opposite side of the membrane from a sound port formed in a housing provided around the membrane and the first perforated backplate. The first perforated backplate may alternatively be located on the same side of the membrane from a sound port formed in a housing provided around the membrane and the first perforated backplate.

Each of the outer walls of one of the plurality of perforation holes in the first perforated backplate may be covered with insulating material. In a further embodiment, each conductive surface of the first perforated backplate is completely covered with insulating material.

The silicon MEMS device may be a capacitive silicon microphone.

Alternatively, the silicon MEMS device may be capacitive silicon microspeaker.

The first perforated backplate of the silicon MEMS device may be composed of doped silicon, doped polysilicon, metal, silicide, carbide, or one or more carbon layers. The membrane may similarly be composed of doped silicon, doped polysilicon, metal, silicide, carbide, or one or more carbon layers.

The insulating layer and/or any further insulating material may be composed of silicon nitride, silicon oxide, or a dielectric material.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A capacitive microphone comprising:

a housing comprising a sound port;

a membrane; and a first backplate, wherein the first plate is perforated and is located between the membrane and the sound port, and wherein a first insulating layer is disposed on at least a portion of a first side of the first backplate facing the membrane that is located directly over the sound port and a second insulating layer is disposed on at least a portion of a second side of the first backplate opposite to the first side of the first backplate that is located directly over the sound port.

2. The capacitive microphone of claim 1, wherein further insulating layers are disposed on each conductive surface of the first backplate.

3. The capacitive microphone of claim 2, wherein each conductive surface of the first backplate is completely covered with insulating material.

4. The capacitive microphone of claim 1, wherein a further insulating layer is disposed on a side wall of at least one of a plurality of perforation holes in the first backplate.

5. The capacitive microphone of claim 4, wherein each of the side walls of at least one of the plurality of perforation holes in the first backplate is covered with insulating material.

6. The capacitive microphone of claim 1, further comprising a circuit configured to provide a bias voltage to the membrane and first backplate.

7. A capacitive microphone comprising: a membrane; and a first perforated backplate, a second perforated backplate located on an opposite side of the membrane from the first perforated backplate, a housing comprising a sound port, the housing surrounding the membrane, the first perforated backplate, and the second perforated backplate; a first insulating layer disposed on at least a portion of an first side of the first backplate facing the membrane that is located directly over the sound port and a second insulating layer disposed on at least a portion of a second side of the first backplate opposite to the first side of the first backplate that is located directly over the sound port; a third insulating layer disposed on at least a portion of an first side of the second backplate facing the membrane that is located directly over the sound port and a fourth insulating layer disposed on at least a portion of a second side of the first backplate opposite to the first side of the first backplate that is located directly over the sound port.

8. The capacitive microphone of claim 7, wherein each conductive surface of the first backplate is completely covered with insulating material.

9. The capacitive microphone of claim 7, wherein an outer wall of one of a plurality of perforation holes in the second perforated backplate is covered with insulating material.

* * * * *